United States Patent [19]

Wesson et al.

[11] Patent Number: 4,762,179

[45] Date of Patent: Aug. 9, 1988

[54] PRESSURE ASSIST DETONATING BAR AND METHOD FOR A TUBING CONVEYED PERFORATOR

[75] Inventors: David S. Wesson, Katy; Robert R. Luke, Houston; Flint R. George, Katy; David M. Haugen, Houston; Kevin R. George, Columbus, all of Tex.

[73] Assignee: Halliburton Company, Duncan, Okla.

[21] Appl. No.: 892,814

[22] Filed: Aug. 4, 1986

[51] Int. Cl.[4] ..... E21B 43/116

[52] U.S. Cl. ..... 166/297; 166/55.1; 175/4.56

[58] Field of Search ..... 89/1 C; 102/318, 322; 166/55, 55.1, 55.2, 297; 175/2, 4.53, 4.54, 4.56

[56] References Cited

U.S. PATENT DOCUMENTS

| | | | |
|---|---|---|---|
| 2,876,701 | 3/1959 | Long . | |
| 3,189,094 | 6/1965 | Hyde | 166/55.1 |
| 3,800,705 | 4/1974 | Tamplen | 175/4.54 |
| 4,531,590 | 7/1985 | Peterson | 175/4.56 |
| 4,544,034 | 10/1985 | George | 166/297 |
| 4,554,981 | 11/1985 | Davies | 175/4.56 |
| 4,606,409 | 8/1986 | Peterson et al. | 166/297 |
| 4,610,312 | 9/1986 | Nelson et al. | 175/4.56 |
| 4,616,718 | 10/1986 | Gambertoglio | 166/297 |

*Primary Examiner*—Stephen J. Novosad
*Assistant Examiner*—William P. Neuder
*Attorney, Agent, or Firm*—James R. Duzan; E. Harrison Gilbert, III

[57] ABSTRACT

A detonator bar has an outer housing, an inner housing connected to the outer housing by at least one first frangible member, an explosive charge disposed in the inner housing, and a firing piston with firing pin held in the inner housing by at least one retaining dog and at least one second frangible member. Operation occurs in response to a relatively small impact force between the detonator bar and a perforator or other explosive object located in a subterranean well. This relatively small impact breaks the at least one first frangible member. Thereafter, a fluid pressure existing in the subterranean well, such as a hydrostatic pressure within a tubing string on which a perforator is conveyed, is used to exert a sufficient force to break the at least one second frangible member after the at least one retaining dog has been released by downward movement of the outer housing relative to the inner housing, which relative movement occurs only after the initial impact force has broken the at least one first frangible member.

23 Claims, 2 Drawing Sheets

PRESSURE ASSIST DETONATING BAR AND METHOD FOR A TUBING CONVEYED PERFORATOR

BACKGROUND OF THE INVENTION

This invention relates generally to detonators for explosive objects in a subterranean well and an associated method. The invention relates more particularly, but not by way of limitation, to a detonating bar and method for actuating a tubing conveyed perforator in response to hydrostatic pressure in the tubing.

There are various known techniques for detonating a perforator located in a well bore to perforate a formation to be treated or produced. The general type of technique particularly pertinent to the present invention is the type moved into the tubing on which the perforator is conveyed into the well and impacted on a stinger extending above the gun of the perforator. An example of such type is disclosed in U.S. Pat. No. 4,512,418, assigned to the assignee of the present invention.

The particular detonator disclosed in U.S. Pat. No. 4,512,418 has two potential shortcomings. One is that it requires a relatively substantial force to be generated upon impact with the stinger before it can detonate the stinger and the gun. This is because operation of the detonator occurs solely from the impact force, which force must be large enough to overcome any and all retaining forces needed to be broken for operating the detonator. The need for this relatively large force generally necessitates that the prior detonator described in the aforementioned patent be dropped into the tubing, rather than lowered into the tubing on a slick line or the like, because such force cannot be readily created when the detonator is carried into the tubing on the slick line or other mechanical means.

This preclusion of use of a slick line or the like is the second potential shortcoming of the specific prior detonator because for such a detonator, which carries a primary explosive, to be totally safe, it should be carried in the well on some type of carrier structure. This is so that if the detonator does not fire, retrieval from the tubing or well bore can be assured. If the detonator is simply dropped into the tubing or the well bore, it must be fished to be retrieved and fishing is not always successful. When fishing is unsuccessful, a potentially serious hazard is created in that when the tubing is to be pulled from the well bore, it must be done so with the unfired explosives in the perforator intact below the unfired detonator. Should the detonator then become dislodged or otherwise caused to impact on the perforator, such as from jarring forces created when the tubing string is being extracted from the well, the perforator could fire at a location which might damage the subterranean formation or, more significantly, it could fire near or at the surface, thereby posing a hazard to the personnel working at the surface.

Therefore, there is the need for an improved detonator for, and an improved method of, actuating a downhole explosive to overcome the foregoing potential shortcomings. Such an improved detonator and method should not be dependent upon a large impact force to operate. The apparatus and method should also utilize a slick line or similar structure so that the detonator can be readily extracted from the tubing if necessary.

SUMMARY OF THE INVENTION

The present invention overcomes the above-noted and other shortcomings by providing a novel and improved detonator and method for actuating, in particular, a perforator. The detonator and method of the present invention are responsive to a relatively small impact force to release components which are then ultimately actuated by fluid pressure within the tubing to activate the perforator. This adds a safety feature to the present invention in that it requires a sufficient pressure differential before the detonator can fire. The present invention also is designed to be run into the tubing, which carries the perforator, on a slick line or other suitable means so that the detonator can be readily withdrawn from the tubing if necessary. The present invention can also utilize a more reliable initiator to make its overall operation more reliable. Thus, the present invention has the capability to fire even in response to a slick line jarring action; it is more reliable; and it is controllable by being responsive to a pressure differential applied to the detonator after an initial releasing action has occurred in response to the initial jarring action of the detonator impacting with the perforator.

Broadly, the apparatus of the present invention is used for detonating an explosive contained in an object located in a subterranean well. This apparatus comprises igniting means for igniting the explosive; and it comprises initiating means, connected with the igniting means, for initiating the operation of the igniting means in response to a fluid pressure in the well. In the preferred embodiment this fluid pressure is a hydrostatic pressure.

The apparatus further comprises inner housing means for carrying the igniting means and the initiating means; outer housing means for carrying the inner housing means; and retainer means for retaining, with a retaining force, the inner housing means stationary relative to the outer housing means until an impact force, generated by engagement of the inner housing means with the object in the well, exceeds the retaining force.

The apparatus still further comprises holding means for holding, with a holding force, a slidable firing member, which is included in the initiating means, stationary relative to the inner housing means until a fluid pressure, communicated through the outer housing means to the holding means, exerts a force exceeding the holding force.

The inner housing means includes an air chamber through which the firing member moves in response to the fluid pressure exerting a force exceeding the holding force of the holding means. The inner housing means further includes a barrier member having a lateral wall, defining a lower barrier which engages the object in the well in generating the impact force, and a longitudinal wall, extending from the lateral wall and engaged by the retainer means and defining a predetermined spacing for separating an explosive of the igniting means from the lateral wall by a distance tending to allow optimum formation of an explosive jet created from the explosive when the firing member strikes the igniting means.

The outer housing means includes means for connecting with a slick line on which the apparatus is to be controllably lowered into the well.

The method of the present invention is particularly used for actuating a perforator, which is conveyed into a well bore on a tubing string, using a detonator bar including an outer housing, an inner housing connected to the outer housing by at least one first frangible member, an explosive charge disposed in the inner housing, and a firing piston with firing pin held in the inner housing by at least one retaining dog and at least one second frangible member. This method comprises the steps of striking the detonator bar on the perforator with a force sufficient to break the at least one first frangible member, moving the outer housing relative to the inner housing so that the at least one retaining dog is released from holding the firing piston relative to the inner housing, and breaking the at least one second frangible member and moving the firing piston and firing pin against the explosive charge in response to a fluid under pressure. The last mentioned step includes communicating a hydrostatic pressure, existing within the tubing string, through the outer housing for acting on the firing piston. The first-mentioned step includes moving the detonator bar through the tubing string on a slick line. The overall method further comprises the step of retaining the firing piston and the explosive charge at opposite ends of an intervening air chamber disposed in the inner housing.

Therefore, from the foregoing, it is a general object of the present invention to provide a novel and improved detonator and method for actuating an explosive object, such as a tubing conveyed perforator, located in a subterranean well. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
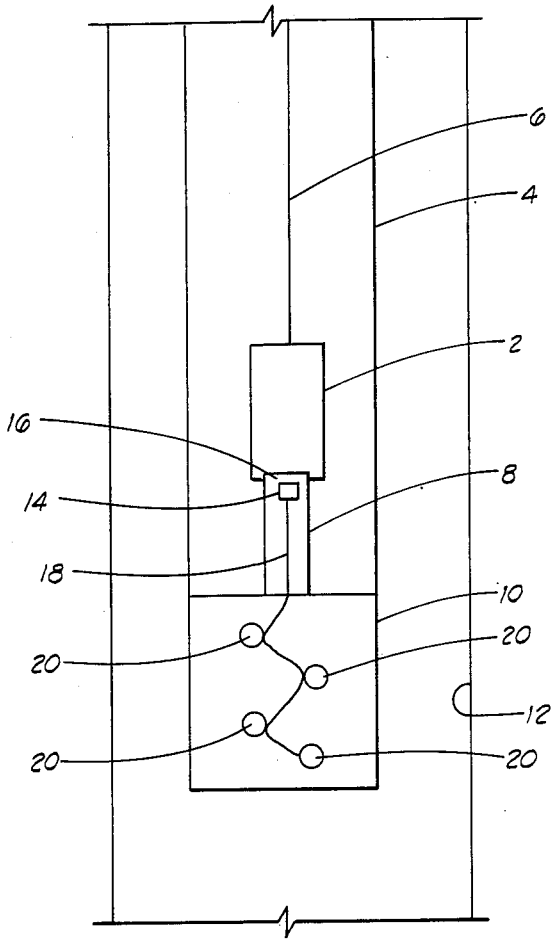
FIG. 1 is a schematic illustration showing a detonator bar, which has been lowered into a tubing string on a slick line, engaged with a stinger extending above a perforating gun of a tubing conveyed perforator.
Figure 2A:
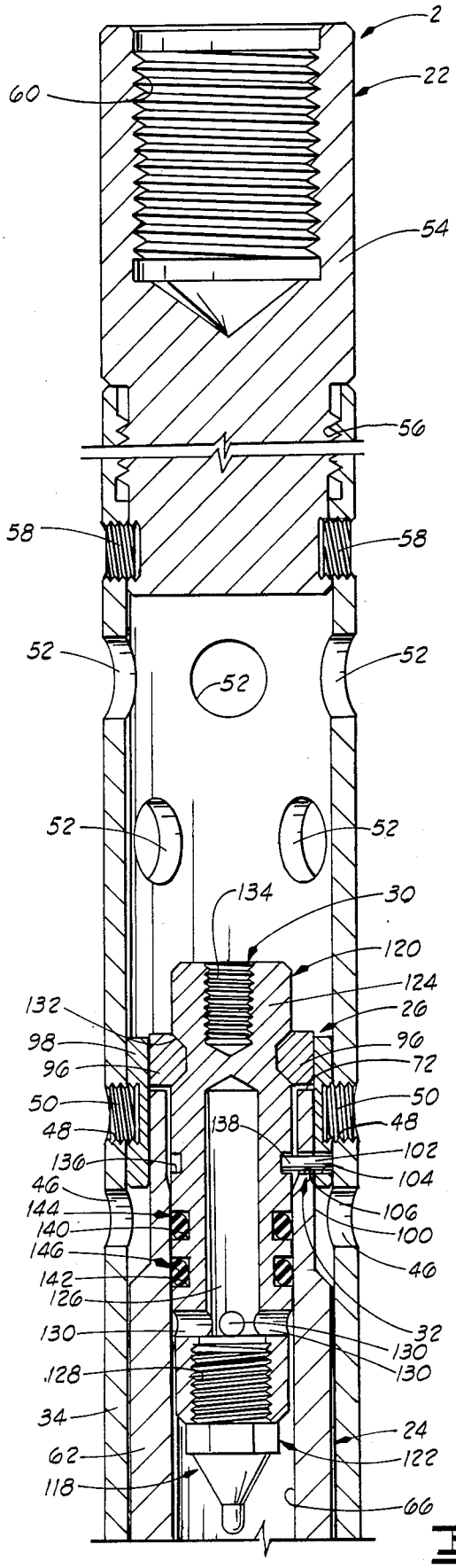
FIGS. 2A and 2B show a sectional view of a preferred embodiment of the detonator bar depicted in FIG. 1.
Figure 2B:
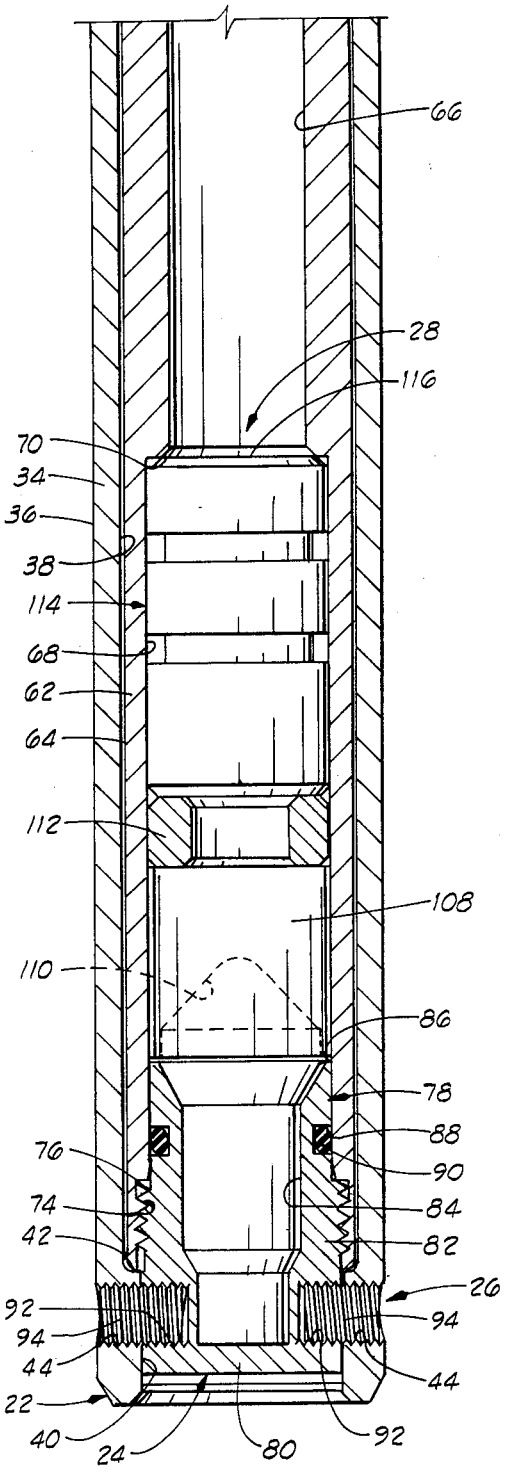

A particular environment in which the preferred embodiment of the present invention is contemplated to be useful is schematically illustrated in FIG. 1. A detonator bar or tool 2, which is constructed in accordance with the preferred embodiment of the present invention as illustrated in FIGS. 2A–2B, is conveyed into a tubing string 4 on a slick line 6 or other suitable conveying means. It is contemplated that the detonator tool 2 can be dropped down the tubing string 4; however, in such case, the advantage of the preferred embodiment whereby the detonator bar 2 can be readily extracted from the tubing string 4 is not obtained.

The detonator bar 2 is lowered into the tubing string 4 for the purpose of engaging a stinger 8 connected to a perforating gun 10 which is carried into a well bore 12 on the tubing string 4. The well bore 12 may be cased or uncased. The stinger 8 and the perforating gun 10 are of suitable types known to the art for defining a tubing conveyed perforator assembly used to perforate the well bore 12 for reasons also known to the art. In general, the stinger 8 includes an explosive charge 14 contained below a barrier wall 16 of the stinger. Extending from the explosive charge 14 is a detonating cord 18 which extends into the perforating gun 10 in communication with one or more shaped charges 20 of secondary explosives disposed in any suitable arrangement in the support structure of the perforating gun 10. Through operation of the detonator bar 2, which operation will be subsequently described, the barrier wall 16 is penetrated by an explosive force which ignites the explosive 14, thereby activating the detonating cord 18 to detonate the charges 20 to create perforations in the adjacent formation intersected by the well bore 12.

The preferred embodiment of the detonator bar or tool 2 shown in FIGS. 2A and 2B includes an outer housing 22, an inner housing 24, and retainer means 26 for retaining, with a retaining force, the inner housing 24 stationary relative to the outer housing 22 until an impact force, generated by engagement of the inner housing 24 with the object to be detonated in the well (namely, the stinger 8 and the perforating gun 10 in the environment illustrated in FIG. 1), exceeds the retaining force. As used herein, "retaining force" and the like may include either or both static strengths and active forces tending or acting to hold an object relative to another object. These forces may be referred to as being "predetermined" in that they are established by the inherent strengths or forces of the means by which the forces are achieved, which means can be selected or controlled for specific desired magnitudes of the forces.

The detonator bar or tool 2 of the preferred embodiment further comprises igniting means 28 for igniting the explosive in the object located in the subterranean wall 12, namely the explosive 16 of the stinger 8 in the illustrated embodiment. Connected with the igniting means 28 by the inner housing 24 is an initiating means 30 for initiating the operation of the igniting means in response to a fluid pressure in the well 12, which in the preferred embodiment is specifically a hydrostatic pressure within the tubing string 4. The detonator bar 2 also includes holding means 32 for holding, with a holding force (again, this "force" may be "predetermined"), the initiating means 30 stationary relative to the inner housing 24 until the fluid pressure, communicated through the outer housing 22 to the holding means 32, exerts a force exceeding the holding force.

The preferred embodiments of each of these components 22, 24, 26, 28, 30, 32 will be described with reference to FIGS. 2A and 2B.

The outer housing 22 provides a means for carrying the inner housing 24. The outer housing 22 is defined by a cylindrical wall 34 having an outer surface 36 and an inner surface 38, which inner surface 38 defines a cavity within the outer housing 22. The wall 34 also has an inner surface 40 radially inwardly offset from the surface 38 by an annular shoulder surface 42 as shown in FIG. 2B. In the preferred embodiment, four threaded holes are defined radially through the wall 34 between the surfaces 36, 40. Two of these holes are identified in FIG. 2B by the reference numeral 44. Additional holes, two of which are partially shown in FIG. 2A and identified by the reference numeral 46, are defined between the surfaces 36, 38 to provide a fluid bypass between the cavity of the outer housing 22 and the exterior of the outer housing. This vents fluid between the inner and outer housings when there is relative longitudinal movement between the inner and outer housing as subsequently described.

Defined above the vent openings 46 are eight additional openings. Two of these are identified in FIG. 2A by the reference numeral 48. These openings receive set screws 50 for holding a portion of the retainer means 26 to the outer housing 22.

Still more openings are defined through the wall 34 between the surfaces 36, 38 above the openings 50. Several of these openings are identified by the reference numeral 52 and shown in FIG. 2A. These openings, or holes, 52 defined through the outer housing wall 34 allow hydrostatic pressure (or other pressure) which exists within the tubing string 4 to pass into the cavity of the outer housing 22 for application to the initiating means 30 and the holding means 32.

The outer housing 22 also includes in the preferred embodiment means for connecting with the slick line 6 on which the tool 2 is to be controllably lowered into the well 12 (specifically, within the tubing string 4). This means is defined in the preferred embodiment by a top adapter 54 threadedly connected to a threaded inner surface 56 of the wall 34. Set screws 58 threadedly connected into still more threaded holes defined through the wall 34 hold or lock the top adapter 54 against rotation relative to the wall 34. The top adapter 54 has a threaded axial bore 60 which couples with the slick line 6 in the preferred embodiment.

The inner housing 24 provides means for carrying the igniting means 28 and the initiating means 30. The inner housing 24 includes a cylindrical wall 62 having an outer surface 64 with a diameter less than the diameter of the inner surface 38 of the wall 34 of the outer housing 22 so that there is sufficient tolerance to permit sliding between the inner and outer housings. The wall 62 has inner surfaces 66, 68 defining a chamber within the interior of the wall 62. The surface 68 is radially offset from the surface 66 by a partially beveled shoulder surface 70. The portion of the chamber defined by the surface 68 receives the igniting means 28 more particularly described hereinbelow. This portion of the chamber is in communication with the chamber portion defined by the surface 66. The portion defined by the surface 66 receives the initiating means 30 and also provides an air chamber in which air at substantially atmospheric pressure is held in the preferred embodiment. The modifier "substantially" is used with reference to the preferred embodiment because the actual air pressure will vary dependent, at least in part, on the ambient temperature, which could vary greatly between a surface temperature and a downhole temperature at the locations where the detonator bar or tool 2 is contemplated to be used. This temperature can also vary dependent upon the position of the initiating means 30 within the chamber because the initiating means 30 is movable through the air chamber in response to the fluid pressure acting through the holes 52 as more particularly described hereinbelow.

The upper (as viewed in its downhole orientation depicted in FIGS. 2A and 2B) end of the wall 62 terminates in an annular surface 72. The lower end of the wall 62 has a threaded inner surface 74 which couples with an outer threaded surface 76 of a barrier member 78 forming another part of the inner housing 24. The barrier member 78 has a lateral or radial end wall 80 from which a longitudinal side wall 82 integrally extends. The walls 80, 82 have inner surfaces defining a counterbored jet directing channel generally identified by the reference numeral 84.

The wall 80 defines a lower barrier which engages the barrier wall 16 of the stinger 8 when the detonator bar 2 is positioned as illustrated in FIG. 1. The engagement between the wall 80 and the wall 16 generates an impact force used to release part of the retainer means 26 subsequently described. The wall 82 is engaged by this portion of the retainer means 26.

The wall 82 has a length defining a predetermined spacing for separating the igniting means 28 from the lateral wall 80 by a distance tending to allow optimum formation of an explosive jet generated when the initiating means 30 strikes the igniting means 28 in a manner subsequently described. As shown in FIG. 2B, the wall 82 extends into the portion of the chamber defined by a section of the inner surface 68 of the wall 62. The wall 82 terminates in an annular surface 86. Contained in a circumferential groove 88 defined in the outer surface of the wall 82 of the barrier member 78 is an O-ring 90 defining seal means for establishing a fluid-tight seal at one end of the total air communicating chamber defined within the wall 62 of the inner housing 24. The wall 82 of the barrier member 78 also has a plurality, four in the preferred embodiment, of cavities, two of which are identified by the reference numeral 92 in FIG. 2B, which are aligned with the openings 44 of the outer housing 22 when shear pins 94 are received in the aligned openings 44, 92.

The shear pins 94 are part of the retainer means 26, which part constitutes frangible means for holding the inner housing 24 within the cavity of the outer housing 22 and stationary relative to the outer housing 22. The shear pins 94 has inherent shear strengths. In the preferred embodiment shear pins with relatively small shear strengths are selected so that a relatively small force can be applied to break or shear the pins 94 to remove the retaining force established by the pins for holding the inner housing 24 stationary relative to the outer housing 22. This separating or breaking force is derived from the impact force generated when the detonator bar 2 is engaged with the stinger 2 by being lowered on the slick line 6 or as is created in response to a jarring action by the use of a jar tool of known type connected above the detonator bar or tool 2. In the present invention the retaining force established by the shear pins 94 is the primary force which must be overcome by the impact force created upon engagement of the tool 2 and the stinger 8. The only other force to be overcome by the impact force is that established by a shear pin 102 associated with another portion of the retainer means 26.

This other portion of the retainer means 26 is shown in FIG. 2A. This portion includes a plurality of dogs, two of which are identified in FIG. 2A by the reference numeral 96. In the preferred embodiment there are six such dogs 96. These dogs are held against the initiating means 30 by a cylindrical dog retainer collar 98 disposed adjacent exterior surfaces of the dogs 96 and adjacent a radially inwardly offset outer surface 100 of the wall 62 of the inner housing 24. The collar 98 is connected to the outer housing 22 by means of the set screws 50 received in the openings 48 of the outer housing 22. The collar 98 is held stationary relative to the wall 62 of the inner housing 24 by an outer portion of the shear pin 102 received through an opening 104 of the collar 98 and an opening 106 of the wall 62 of the inner housing 24. This outer portion of the pin 102 provides a relatively light retaining force which is enough to hold the collar 98 against the dogs 96 during assembly. It is contemplated that the function of the dogs 96, the collar 98 and the pin 102 can be equivalently achieved by other suitable means, such as by other shear pin constructions or by the use of rupture disks or other means as would be readily known to those skilled in the art.

The igniting means 28 in the preferred embodiment includes explosive means for generating an explosive jet for application to the lateral barrier wall 80 of the inner housing 24, the barrier wall 16 of the stinger 8 and, ultimately, the explosive 14 in the stinger 8. This explosive means is disposed in the chamber portion defined by the inner surface 68 of the wall 62 of the inner housing 24. This chamber portion is in fluid communication with the air chamber portion defined by the surface 66 in view of the seal 90 being disposed in sealing engagement with the wall 62 near the lower end of the surface 68. In the preferred embodiment the explosive means includes a shaped charge 108 of primary explosive of a type known to the art. The shaped charge is substantially cylindrical but has a conical concave face 110 directed at the counterbore 84 of the barrier member 78. This end of the shaped charge 108 abuts the annular end surface 86 of the barrier member 78 as shown in FIG. 2B.

The explosive means also includes an annular spacer member 112 disposed in the chamber of the inner housing 24 adjacent the end of the shaped charge 108 opposite the end abutting the barrier member 78. Disposed in the chamber adjacent the spacer member 112 opposite the shaped charge 108 is an initiator charge 114, which in the preferred embodiment in a Vann High Temperature Initiator of a type as known to the art. The opposite end of the initiator charge 114 lies near or abuts the beveled shoulder surface 70 of the inner housing 24.

Other configurations of the explosive means can be utilized. One such alternative, but not by way of limitation, would be to space the initiator charge 114 further from the shaped charge 108 and functionally interconnect the two by a detonating cord of a suitable type known to the art.

The explosive means of the igniting means 28 is fired in response to an impact force caused by moving the initiating means 30 against an upper surface 116 of the initiator charge 114. In the preferred embodiment this initiating means 30 includes a slidable firing member 118 initially received and held in the upper end of the air chamber defined by the surface 66 of the inner housing 24. The firing member 118 includes a firing piston 120 and a firing pin 122 threadedly received in the lower end of the piston 120 as shown in FIG. 2A.

The piston 120 is substantially cylindrical as defined by an integral wall 124 having an inner surface 126 extending axially through a major portion of the length of the piston 120 to a threaded outlet 128 in which the firing pin 122 is threadedly received. Defined radially through the wall 124 are ports 130 which communicate the air pressure within the air chamber of the inner housing 24 into the interior of the piston 120. This hollow interior region of the piston 120 provides a reduced mass to the piston 120, which is of significance in insuring that the bar 2 is able to pass "drop test" safety requirements or goals. This hollow interior region also provides a larger volume into which the air within the chamber of the inner housing 24 can be received when the firing member 118 slides downwardly into contact with the initiator charge 114.

The wall 124 of the piston 120 also has an external circumferential groove 132 for receiving the dogs 96 when the dogs 96 are held by the retainer collar 98.

Defined axially into the end of the wall 124 opposite the opening into the threaded outlet 128 is a threaded bore 134 for connecting to a fishing tool which can be used to extract the piston from the housings.

A circumferential groove 136 is defined around the wall 124 below the groove 132. The groove 136 receives an end portion 138 of the shear pin 102 to hold the piston 120 stationary relative to the inner housing 24 even when the dogs 96 have been released from the groove 132.

Additional circumferential grooves, identified by the reference numerals 140, 142 are defined around the wall 124 of the piston 120. O-ring/back-up ring sets 144, 146 are received in the grooves 140, 142, respectively, for defining a sliding seal between the firing piston 120 and the surface 66 of the wall 62 of the inner housing 24 so that a variable sealed volume is defined within the chamber of the inner housing 24 between these seal sets 144, 146 and the seal defined by the O-ring 90. The variability of this sealed volume is achieved by means of the sliding movement which can be imparted to the firing member 118 relative to the inner housing 24 as subsequently described.

The firing pin 122 connected to the firing piston 120 is of a suitable type known to the art and having, in the preferred embodiment, a configuration as illustrated in FIG. 2A. This configuration allows the firing pin 122 to contact and penetrate the surface 116 of the initiator charge 114 when the firing member 118 is moved downwardly in response to a fluid pressure communicated through the openings 52 in the outer housing 22.

The firing member 118 is held against such downward movement by the holding means 32. In the preferred embodiment the holding means 32 is defined by the end portion 138 of the shear pin 102 which holds the firing member 118 near the top of the inner housing 24 so that, in this position, the maximum variable sealed volume is defined in that the separation between the seal sets 144, 146 and the seal 90 is at its maximum. The frangible member defined by the shear pin 102 in the preferred embodiment thus engages both the dog retainer collar 98 and the firing member 118. When the pin 102 is intact, it holds the firing member 118 spaced from the explosive means of the igniting means 28 which is disposed in the variable volume of the chamber of the inner housing 24 near the opposite end, near where the seal 90 is established. This end of the pin 102 not only holds the firing member 118 away from the igniting means 28, but it also prevents the firing member 118 from "backing out" of the inner housing 24 in response to the air pressure acting on the nose of the firing member 118 within the air chamber of the inner housing 24. This "backing out" could otherwise occur while the bar 2 is being lowered into the tubing string 4 prior to encountering a hydrostatic fluid level.

To use the present invention in the environment illustrated in FIG. 1, the detonator bar 2 is lowered into the tubing string 4 on the slick line 6 until it stabs over the receiving end of the stinger 8. This can be facilitated by using a suitable guide structure as known to the art. In stabbing the detonator bar 2 over the receiver, the upper surface of the barrier wall 16 is received into the lower end of the outer housing 22 within the space defined by the inner surface 40 of the outer housing 22 and the lower surface of the barrier wall 80 of the inner housing 24.

In stabbing the detonator bar 2 onto the receiver 8, the detonator bar is caused to strike this portion of the perforator with a force sufficient to break the portion of the retainer means 26 defined by the frangible shear pins 94 and the outer end of the shear pin 102. This striking or impact force can be achieved simply through the lowering force from the weight of the detonator bar and the slick line 6 or by using a jarring tool and jar weights located above the detonator bar in a manner as would be readily known to those skilled in the art. This striking force need only be relatively small because it needs to overcome only the shear strength established by whatever number of shear pins 94 are used and the single shear pin 102.

In breaking the shear pins 94 and the outer end of the shear pin 102, a portion of the shear pin 102 being broken by the relative movement between inner housing 24 and collar 98 secured to outer housing 22 by set screws 50, the inner housing 24 and collar 98 having a portion of shear pin 102 extending through holes 106 and 104 respectively therein, the outer housing 22 moves relative to the inner housing 24. Once the shear pins 94, and the outer end of the shear pin 102 have been broken, the outer housing 22 is free to move farther longitudinally relative to the inner housing 24. This movement of the outer housing 22 is downward in view of the inner housing 24 being held stationary on top of the stinger 8 and in view of the abutment between the lower portion of the wall 62 of the inner housing 24 and the shoulder 42 of the outer housing 22. This lowering action is achieved by releasing tension from the slick line 6 or by utilizing jar weights or other suitable means to apply a sufficient weight on the outer housing 22. It should be noted that the end 138 of shear pin 102 cannot be broken or sheared by any force acting on firing piston 120 at this time because the dogs 96 are retained in groove 132 of firing piston 120 by dog retaining collar 98.

When downward movement of the outer housing 22 occurs relative to the inner housing 24, the dog retainer collar 98 is carried with the outer housing 22 in view of it being coupled to the outer housing 22 by the set screws 50. After sufficient downward movement, the dog retaining collar 98 no longer holds the dogs 96 in the groove 132 of the firing piston 120. This releases this retaining force which has theretofore locked the firing member 118 against any downward movement relative to the inner housing 24. In the preferred embodiment the dogs 96 are tended to be forced out of the groove 132 by the pressure communicated into the interior of the outer housing 22 through the openings 52. In the preferred embodiment this pressure is a hydrostatic pressure from the fluid existing within the tubing string 4.

Once the dogs 96 have been released and separated from the firing member 118, the firing member 118 is then held stationary relative to the inner housing 24 by means of only the end 138 of the shear pin 102. It is with this end 138 that the predetermined holding force is defined, which holding force is overcome only in response to the application or the existence of a sufficient pressure differential between a pressure acting downwardly on the firing piston 120 and the opposing air pressure contained within the chamber of the inner housing 24. Although this predetermined holding force can be of any suitable strength, in the preferred embodiment it is contemplated that the holding strength will require a pressure differential of approximately 500 pounds per square inch.

Once the pressure differential is sufficient, the pin 102 is broken at the end 138 and the firing member 118 moves downwardly through the intervening air chamber into contact with the initiator charge 114. In the preferred embodiment the intervening air chamber is made a sufficient length to allow the firing member 118 to generate a sufficient firing or initiating force to fire the initiator charge 114.

When a sufficient impact between the firing pin 122 and the initiator charge 114 occurs, the initiator charge 114 explodes and throws out a fire plate which passes through the open center of the annular spacer member 112 to impact upon and detonate the shaped charge 108 of primary explosive. The shaped charge 108 generates an explosive jet focused by means of the conical concave face 110 and the counterbore 84 of the barrier member 78. The charge 108 and the length of the barrier member 78 are designed so that the explosive jet will have a sufficient force to penetrate the barrier wall 80 of the detonator bar 2 and the barrier wall 16 of the stinger 8 to ignite the explosive charge 14 contained in the stinger 8. When the explosive charge 14 ignites, it activates the detonating cord 18 to fire the shaped charges 120 by which the well bore is perforated.

Thus, the present invention needs only a relatively small impact force between the detonator bar and the object to be exploded in the subterranean well to release the detonator bar to the fired by another force existing within the well, such as the hydrostatic pressure within the tubing on which a perforator is conveyed into the well. Furthermore, the present invention can be carried on a slick line and still be reliably operated without risk of being unable to retrieve a malfunctioning or nonfunctioning detonator. The pressure assist firing feature of the present invention provides a safety factor in that no detonation will occur until a sufficiently large pressure differential is encountered, which such differential would likely not be encountered at the surface where personnel would be carrying the detonator. By having the primary explosive in a detonator bar which is carried into the well separately from the perforating gun, there is no chance of accidentally firing the gun before it is located downhole.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts and the performance of steps can be made by those skilled in the art, which changes are encompassed within the spirit of this invention as defined by the appended claims.

What is claimed is:

1. An apparatus for detonating an explosive contained on an object located in a subterrean well, comprising:

igniting means for igniting the explosive contained on said object located in said subterrean well;

initiating means, connected with said igniting means, for initiating the operation of said igniting means in response to a fluid pressure in said subterrean well, said initiating means including a slidable firing member;

inner housing means for carrying said igniting means and said initiating means, said inner housing including an air chamber through which said firing member moves in said inner housing;

outer housing means for carrying said inner housing means;

retainer means extending between said inner housing and said outer housing for frangibily releasably retaining, with a retaining force, said inner housing means stationary relative to said outer housing means until an impact force, generated by the engagement of said inner housing means with the object in the said well, exceeds said retaining force whereupon said outer housing means and said inner housing means move relative to each other to thereby allow said inner housing means to move within said outer housing means from a first position to a second position therein; and holding means extending between said inner housing and said firing member for releasably holding, with a holding force said firing member stationary relative to said inner housing means until a fluid pressure, communicated through said outer housing means to said holding means, exerts a force exceeding the holding force whereby after said impact force has released said retainer means from retaining said inner housing stationary relative to said outer housing thereby allowing said inner housing to move from a first position to a second position in said outer housing, when said fluid pressure exerting a force exceeds the holding force of said holding means, said firing member moves through said air chamber in said inner housing thereby causing said igniting means to cause, in turn detonation of said explosive.

2. An apparatus as defined in claim 1, wherein:

said igniting means includes explosive means, disposed in said inner housing means, for generating an explosive jet for application to the device located in the well; and said inner housing means includes a barrier member having a lateral wall, defining a lower barrier which engages the object in the well in generating the impact force, and a longitudinal wall, extending from said lateral wall and engaged by said retainer means and defining a predetermined spacing for separating said explosive means from said lateral wall by a distance tending to allow optimum formation of the explosive jet when said firing member strikes said explosive means.

3. An apparatus as defined in claim 1, wherein said outer housing means includes means for connecting with a slick line on which said apparatus is to be controllably lowered into the well.

4. An apparatus as defined in claim 1, wherein the fluid pressure is a hydrostatic pressure.

5. A pressure assist detonating bar for a tubing conveyed perforator for use in a well having fluid contained therein, comprising:

an outer housing having a wall defining a cavity within said outer housing;

an inner housing having a wall defining a chamber within said inner housing, said inner housing being slidably disposed in a first position within said outer housing;

first frangible means having a first portion engaging a portion of said outer housing and a second portion engaging said inner housing for releasably holding said inner housing within said cavity in said first position within said outer housing and stationary relative to said outer housing until a force is applied to said first frangible means to cause said first frangible means to release said inner housing from said outer housing to thereby allow relative movement of said inner housing with respect to said outer housing;

a firing piston having a firing pin, said firing pin having a portion thereof contacted by said fluid in said well, said firing piston movable within a portion of said inner housing from a first position to a second position therein;

second frangible means for holding said firing piston within said chamber in said inner housing in said first position therein until said force is applied to said first frangible means thereby causing said first frangible means to release said inner housing from said outer housing thereby allowing movement of said inner housing with respect to said outer housing whereupon another force applied to said firing piston thereby causes said second frangible means to release said firing piston from its first position within said chamber in said inner housing; and explosive means, disposed in said chamber of said inner housing and spaced from said firing piston while said firing piston is held by said second frangible means in said first position within said chamber in said inner housing, for creating an explosive for to ignite the perforator in response to engagement by said firing pin after said first frangible means has been broken by a force and after said second frangible means has been broken by a another force generated by a hydrostatic pressure in the tubing on which the perforator is conveyed when said firing pin moves from its first position within said chamber in said inner housing to a second position within said chamber.

6. A bar as defined in claim 5, wherein said wall of said outer housing has at least one hole defined therethrough for communicating the hydrostatic pressure from the tubing to said second frangible means.

7. A bar as defined in claim 5, further comprising:

a plurality of dogs; and a dog retainer collar connected to said outer housing and engaging said dogs so that said dogs are held in contact with said firing piston and said inner housing while said first frangible means holds said inner housing stationary relative to said outer housing.

8. A bar as defined in claim 7, wherein said second frangible means engages said dog retainer collar.

9. A bar as defined in claim 5, wherein:

said inner housing includes first seal means for defining a seal near one end of said chamber of said inner housing;

said detonating bar further comprises second seal means, mounted on said firing piston, for defining a sliding seal between said firing piston and said wall of said inner housing so that a variable sealed volume is defined within said chamber of said inner housing between said first and second seal means;

said explosive means is disposed in said variable volume of said chamber near said first seal means; and said second frangible means holds said firing piston relative to said inner housing so that the maximum variable sealed volume is defined thereby.

10. A bar as defined in claim 9, further comprising air, at substantially atmospheric pressure, contained in said variable sealed volume.

11. A bar as defined in claim 5, wherein:

said inner housing includes a barrier member having a lateral wall, extending across said inner housing, and a longitudinal wall, extending from said lateral wall into said chamber of said inner housing; and said explosive means includes a shaped charge disposed in said chamber and having an end abutting the end of said longitudinal wall opposite said lateral wall.

12. A bar as defined in claim 11, wherein said explosive means further includes:

a spacer member disposed in said chamber of said inner housing adjacent said shaped charge; and an initiator charge disposed in said chamber adjacent said spacer member opposite said shaped charge.

13. A method of actuating a perforator, which is conveyed into a well bore on a tubing string, using a detonator bar including an outer housing, an inner housing connected to the outer housing by at least one first frangible member, an explosive charge disposed in the inner housing, and a firing piston with firing pin held in the inner housing by at least one retaining dog and at least one second frangible member, said method comprising the steps of:

(a) striking the detonator bar on the perforator with a force sufficient to break the at least one first frangible member;

(b) moving the outer housing relative to the inner housing so that the at least one retaining dog is released from holding the firing piston relative to the inner housing; and (c) breaking the at least one second frangible member and moving the firing piston and firing pin against the explosive charge in response to a fluid under pressure.

14. A method as defined in claim 13, wherein said step (c) includes communicating a hydrostatic pressure, existing within the tubing string, through the outer housing for acting on the firing piston.

15. A method as defined in claim 13, further comprising, prior to said step (a), the step of retaining the firing piston and the explosive charge at opposite ends of an intervening air chamber disposed in the inner housing.

16. A method as defined in claim 13, wherein said step (a) includes moving the detonator bar through the tubing string on a slick line.

17. A bar as defined in claim 5, wherein said firing piston has a hollow interior region in communication with said chamber of said inner housing.

18. An apparatus for detonating an explosive contained in an object located in a subterrean well, said apparatus comprising:

igniting means for igniting the explosive contained on said object located in said subterrean well;

initiating means, connected with said igniting means, for initiating the operation of said igniting means in response to a fluid pressure in said subterrean well, said initiating means include a slidable firing member;

first member means for carrying said igniting means, and said initiating means, said first member means including a chamber through which said firing member means in said first member means;

second member means releasably secured to a portion of said first member means surrounding a portion thereof;

retainer means, extending between said first member and said second member for frangibily releasably retaining, with a retaining force, said second member means stationary relative to said first member means until an impact force, generated by the engagement of said second member means by a force within said well while said first member means remains stationary in said well, exceeds said retaining force whereupon said second member means and said first member means move relative to each other to thereby allow a portion of said second member means to move axially with respect to said first member means from a first position to a second position; and holding means extending between said first member and said firing member for holding, with a holding force said firing member stationary relative to said first member means until said second member means has moved from said first position to said second position with respect to said first member means whereby a fluid pressure communicated to said firing member means acts upon said firing member means to cause said firing member means to move through said chamber in said first member means thereby causing said igniting means to ignite to cause, in turn, detonation of said explosive.

19. The apparatus as defined in claim 18, wherein the fluid pressure is hydrostatic pressure.

20. A method of actuating a perforator, which is conveyed into a well bore on a tubing string, using a weighted mass including a first member, a second member connected to the first member by at least one first frangible member, an explosive charge disposed in the second member, and a firing piston with firing pin held in the second member by a releasable means member, said method comprising the steps of:

(a) striking the weighted mass on the perforator with a force sufficient to break the at least one first frangible member;

(b) moving the first member relative to the second member so that the releasable means is released from holding the firing piston relative to the second member; and (c) moving the firing piston and firing pin against the explosive charge in response to the fluid under pressure in the well bore.

21. A method as defined in claim 20, wherein said step (c) includes communicating a hydrostatic pressure, existing within the tubing string, through the first member for acting on the firing piston.

22. A method as defined in claim 20, further comprising, prior to said step (a) the step of retaining the firing piston and the explosive charge at opposite ends of an intervening air chamber disposed in the second member.

23. A method as defined in claim 22, wherein said step (a) includes moving the weighted mass through the tubing string on a slick line.

* * * * *